US006374071B1

(12) United States Patent
Sato

(10) Patent No.: US 6,374,071 B1
(45) Date of Patent: Apr. 16, 2002

(54) CHARGING UNIT, A MANUFACTURING METHOD THEREOF, A CHARGING DEVICE USING THE CHARGING UNIT, AND A TRANSFER DEVICE USING THE SAME

(75) Inventor: Masamichi Sato, Saitama (JP)

(73) Assignee: Keytech Co., Ltd., Tokyo (JP)

( * ) Notice: Subject to any disclaimer, the term of this patent is extended or adjusted under 35 U.S.C. 154(b) by 0 days.

(21) Appl. No.: 09/704,758

(22) Filed: Nov. 3, 2000

(51) Int. Cl.[7] ..... G03G 15/02; G03G 15/16

(52) U.S. Cl. ..... 399/174; 361/225; 399/168; 399/313

(58) Field of Search ..... 399/168, 174, 399/176, 297, 313, 318; 361/225

(56) References Cited

U.S. PATENT DOCUMENTS 5,243,387 A * 9/1993 Ikegawa ..... 399/176
5,534,344 A * 7/1996 Kisu et al. ..... 361/225 X
5,655,188 A * 8/1997 Nagamori et al. ..... 399/174
5,822,169 A * 10/1998 Yoshioka et al. ..... 361/225

FOREIGN PATENT DOCUMENTS

JP 05273844 10/1993
JP 07-020733 * 1/1995
JP 11-119565 * 4/1999

* cited by examiner

*Primary Examiner*—Sandra Brase
(74) *Attorney, Agent, or Firm*—Young & Thompson

(57) ABSTRACT

A charging device or a transfer device used for an electrophotographic printer includes a charging unit. In this charging unit, a shaft is loosely encased by a conductive elastic cylinder. Further, the conductive elastic cylinder is loosely encased by a seamless charging tube. As to the charging device, the charging unit is pressed against a photosensitive drum. The seamless charging tube and the conductive elastic cylinder are driven to rotate in association with a rotation of the photo sensitive drum. A charging voltage is applied between the seamless charging tube and the photosensitive drum.

21 Claims, 6 Drawing Sheets

CHARGING UNIT, A MANUFACTURING METHOD THEREOF, A CHARGING DEVICE USING THE CHARGING UNIT, AND A TRANSFER DEVICE USING THE SAME

BACKGROUND OF THE INVENTION

1. Field of the Invention

The present invention relates to a charging unit and a manufacturing method thereof. Further, the present invention relates to a charging device and a transfer device utilized in a copying machine, a printer and so forth of an electrophotographic system.

Electrophotography means electrostatic copying, electrostatic recording and so forth. In the field of the electrophotography, a device for applying an electric charge to a surface of a photosensitive material is called as a charging device. Meanwhile, a device for applying a voltage to a recording medium is called as a transfer device. This transfer device applies the voltage in order to transfer a toner image, which is formed on a photosensitive material, to the recording medium (a paper, a film and so forth). The charging unit and the charging device according to the present invention are not exclusive to the field of the electrophotography, but are applicable to any cases in that the electric charge is applied to a surface to be charged. The material to be charged may be any one of a drum shape, a belt shape, a sheet shape and so forth.

2. Description of the Related Art

Both of the charging device and the transfer device comprise the charging unit, and charge the material in a same principle. Their uses are merely different. For this reason, the charging unit and the charging device are mainly described hereinafter. As to a charging method in the field of electrophotography, is widely used a contact charging system (roller, tube, blade, blush and so forth) in which ozone is hardly generated, instead of a corona discharging system accompanying generation of ozone. A roller charging system is widely used as one of the contact charging system. This system uses a charging roller comprising shaft, a conductive elastic layer provided around the shaft, and a charging layer provided around them. Although the roller charging system represents the contact charging systems, there arise problems in that it costs to manufacture the charging roller, and in that it costs to peel the conductive elastic layer from the shaft when discarding or recycling, and in that the discarded material is not good for environment. In order to solve above problems, it has recently been proposed to use a seamless charging tube.

The charging roller and the charging device using the seamless charging tube is described in Japanese Laid-Open Publication No. 5-273844, for example. FIG. 9 shows a first embodiment of the charging roller described in the above Publication, and FIG. 10 shows a second embodiment thereof.

In FIG. 9, the charging roller 30 comprises a conductive shaft 2*a*, a conductive foam layer 2*b* integrally formed on an outer surface of the shaft 2*a*, and a seamless charging tube 2*c* loosely encasing the foam layer 2*b* without adhering to a peripheral surface thereof. In other words, an inner diameter of the charging tube 2*c* is larger than an outer diameter of the conductive foam layer 2*b*. Both ends of the shaft 2*a* of the charging roller 30 are held by a bearing member, and the charging roller 30 is pressed against an outer surface of a photosensitive drum 1 by means of a spring 23 provided both ends of the shaft 2*a* under a predetermined pressing force (1 Kg).

The whole of the charging roller 30 including the seamless charging tube 2*c* is driven to rotate in association with a rotation of the photosensitive drum 1. A power supply 4 applies, to the charging roller 30, a superposed oscillating voltage (Vac+Vdc) with an alternating voltage Vac (2 kVpp, 600 Hz) and a DC voltage Vdc(−700 V) corresponding to a desired surface voltage. The voltage is applied via a slide electrode 24 contacted to the shaft 2*a*. Owing to this, the voltage is applied to the charging tube 2*c* via the shaft 2*a* and the conductive foam layer 2*b*. Thus, charges are interchanged at a pressure nip portion between the charging roller 30 and the photosensitive drum 1 so that the outer surface of the photosensitive drum 1 is charged up to the desired surface voltage. Incidentally, the photosensitive drum 1 and the power supply are identical with those denoted by reference numerals 1 and 4 in FIG. 1. The spring 23 and the bearing member are identical with those denoted by reference numerals 3 and 11 in FIG. 2.

A charging roller 31 shown in FIG. 10 comprises a conductive elastic cylinder 2*d* formed in a thick cylindrical shape, the charging tube 2*c* integrally covering the conductive elastic cylinder 2*d*, and the shaft 2*a* loosely inserted into a hollow of the elastic cylinder 2*d*. The elastic cylinder 2*d* loosely encases the shaft 2*a*, and the inner diameter of the elastic cylinder 2*d* is larger than the outer diameter of the shaft 2*a*. The charging roller 31 is supported similarly to the embodiment 1 shown in FIG. 9 so as to be pressed against the outer surface of the photosensitive drum 1. The charging tube 2*c* closely contacts with the outer surface of the photosensitive drum 1, by the pressing force of the spring 23, at the pressure nip portion between the charging roller 31 and the photosensitive drum 1. Meanwhile, a state that the shaft 2*a* closely contacts with the surface of the hollow of the elastic cylinder 2*d* is kept. The charging roller 31 including the elastic cylinder 2*d*, the charging tube 2*c* and the shaft 2*a* is driven to rotate in association with the rotation of the photosensitive drum 1. Similarly to the foregoing embodiment 1, the superposed oscillating voltage is applied. The voltage is applied to the charging tube 2*c* via the shaft 2*a* and the conductive elastic layer 2*d* so that the outer surface of the photosensitive drum 1 is charged up to the desired surface voltage.

The inventor of the present application has confirmed the following problems of the charging roller shown in FIG. 9 and the charging device using thereof. The first problem relates to the cost. As methods for integrally forming the foam layer 2*b* on the surface of the shaft 2*a*, two methods are known. In the first method, a foam material of conductive rubber is formed encasing the shaft 2*a* and then ground in a predetermined thickness. In the second method, a foam material of conductive rubber is formed in a cylindrical shape by an extruding machine such that its inner diameter is smaller than the outer diameter of the shaft 2*a*, and then, the air is blown into the cylindrical body to enlarge the inner diameter of the foam material rather than the outer diameter of the shaft 2*a*. In this state, the shaft is inserted into the cylindrical body. The cost of the second method is lower than that of the first method, however, a considerable cost is spent in both methods. The latter method needs the cost for inserting the shaft into the hollow of the cylindrical body, besides the cost for merely forming the cylindrical body.

The second problem relates to a shift of the charging tube 2*c* during the rotation. Since the charging tube 2*c* loosely encases the outer surface of the foam layer 2*b*, the charging tube 2*c* moves little by little in an axial direction in accordance with the rotation of the photosensitive drum 1. Manufacturing accuracy of the respective parts has a limit so that combination of ideal dimensions can not be obtained relative to the respective parts. Thus, in practice, it is impossible to prevent the charging tube 2*c* from moving in the axial direction. Owing to this movement, an end portion of the charging tube 2*c* abuts on the bearing member of the shaft 2*a*. In case the pressing force is about 1 Kg, a frictional force between the charging tube 2*c* and the foam layer 2*b* becomes large so that the charging tube 2*c* can not be pushed back by the bearing member. Hence, the force for pressing the bearing member becomes large more and more. Eventually, the edge of the charging tube 2*c* is turned over or deformed. Due to this, it becomes impossible to perform uniform charging. Such a phenomenon tends to occur as the frictional force between the charging tube 2*c* and the foam layer 2*b* is larger, and as the charging tube 2*c* is thinner (for example, 50–70 $\mu$m), and as the material used for the charging tube 2*c* is softer.

It has been found that the embodiment 2 shown in FIG. 10 has the following problems. The first problem relates to a shift of the elastic cylinder 2*d* during the rotation. Since the elastic cylinder 2*d* loosely encases the shaft 2*a*, the elastic cylinder 2*d* moves in the axial direction in accordance with the rotation of the photosensitive drum 1 similarly to the case of FIG. 9. As a result, the elastic cylinder 2*d* is pressed against the bearing member together with the charging tube 2*c*. Upon this, a sound by friction is likely to be generated. Meanwhile, the elastic cylinder 2*d* is much thicker than the charging tube 2*c* and is hardly damaged. However, when the elastic cylinder 2*d* is strongly pressed against the bearing member, the edge of the elastic cylinder 2*d* is compressed, and creases are sometimes generated at that portion of the charging tube 2*c*. If such a phenomenon occurs, it becomes impossible to perform uniform charging. The second problem relates to non-uniformity of the conductive elastic cylinder. As to the elastic cylinder 2*d* formed by the extruding machine, a thicker portion and a thinner portion exist. Since the thickness of the charging tube 2*c* is thin, the outer diameter of the charging tube 2*c* has a larger portion and a smaller portion corresponding to the outer diameter of the elastic cylinder 2*d* when the charging tube 2*c* is integrally provided on the outer periphery of the elastic cylinder 2*d*. In case the outer diameter is larger, a pressure nip width is longer. By contrast, in case the outer diameter is smaller, the nip width is shorter. When the nip width is different, the amount of charge deposited on the surface of the photosensitive drum 1 is different. If portions having different outer diameters exist in one charging roller, it becomes impossible to perform uniform charging. In view of this, after the conductive elastic cylinder 2*d* is formed by the extruding machine, the outer surface is usually ground to obtain a predetermined constant diameter. Thus, the cost for a grinding process is necessary. The third problem relates to a problem in that items of reusable parts are less. When the charging tube 2*c* is soiled or is damaged and the charging roller becomes unusable, the shaft can be reused. However, the conductive elastic cylinder and the charging tube can not be reused so that they are scrapped.

SUMMARY OF THE INVENTION

In view of the foregoing, it is a primary object of the present invention to provide a charging unit which is hardly damaged at the edge of a seamless tube and can perform uniform charging.

It is a second object of the present invention to provide a charging unit which hardly generates creases on the seamless charging tube and can perform uniform charging.

It is a third object of the present invention to provide a charging unit which uses a conductive elastic cylinder formed by extruding machine, the surface thereof being not ground.

It is a fourth object of the present invention to provide a method for manufacturing a charging unit in which it is unnecessary to integrally form a conductive elastic cylinder on a shaft.

It is a fifth object of the present invention to provide a method for manufacturing a charging unit in which a lot of parts may be reused and is good for the environment.

It is a sixth object of the present invention to provide a method for manufacturing a charging unit in which a process for grinding a surface is unnecessary.

It is a seventh object of the present invention to provide a charging device and a transfer device using the charging unit according to the present invention.

The above and other objects are achieved by the charging unit constituted of a shaft, a conductive elastic cylinder loosely encasing the shaft, and a seamless charging tube loosely encasing the conductive elastic cylinder. An inner diameter of the conductive elastic cylinder is larger than an outer diameter of the shaft. An inner diameter of the seamless charging tube is larger than the outer diameter of the conductive elastic cylinder.

The seamless charging tube is made in such a manner, for example, that a semi-conductive polymer is formed in a tube shape by extruding machine. The semi-conductive polymer includes, for example, polyamide elastomer in which conductive carbon is mixed. The conductive elastic cylinder is made in such a manner that synthetic rubber in which conductive carbon and a foaming agent are added is formed in a pipe shape by extruding machine. The elastic cylinder and the charging tube loosely encase the shaft in order.

The charging device according to the present invention includes the above-mentioned charging unit, a bearing member and a press member. The bearing member holds both ends of the shaft of the charging unit. The press member presses the charging tube of the charging unit against a material to be charged by pushing the shaft toward the material to be charged. A charging voltage is applied between the charging tube and the material to be charged. The charging tube, the elastic cylinder and the shaft are driven to rotate in association with the movement of the material to be charged.

The transfer device according to the present invention includes the above-mentioned charging unit, a bearing member, and a press member. The bearing member holds both ends of the shaft. The press member presses the charging tube against the material having thereon a toner image by pushing the shaft toward the material having thereon a toner image. A transfer voltage is applied between the charging tube and the material having thereon a toner image with a recording medium disposed therebetween in order to transfer the toner image.

In a preferred embodiment of the present invention, a stopper is rotatably attached to the shaft to prevent the charging tube loosely encasing the elastic cylinder from continuing to move in an axial direction of the shaft during rotation of the charging unit. The stopper is disposed between the end of the charging tube and the nearest bearing member. Moreover, a regulating member may be attached for regulating the elastic cylinder so as not to protrude out of both ends of the charging tube. In order to prevent the stopper from dropping out of the shaft, a drop preventing member may be provided between the stopper and the nearest end of the shaft. This preventing member prevents the stopper from moving to the end of the shaft and dropping out from it. A stopper having a special structure may be used as the regulating member and the drop preventing member.

Further, the bearing member of the charging device may be used as the stopper and/or the regulating member.

The charging unit according to the present invention has advantages relative to its performance, its cost, and the environment in recycling and discarding. Moreover, there is another advantage that the life of a photosensitive drum may be extended. These advantages are obtained by the structure in which the seamless charging tube and the conductive elastic cylinder are individually provided, and the charging tube and the elastic cylinder compensate aforesaid problems mutually. Further, the present invention solves the troubles regarding the end portion of the charging unit, and also solves the problems regarding materials of the respective member, shapes thereof, and a limit of the production accuracy of the conductive foam layer.

The life of the charging unit mainly depends on the life of the seamless charging tube. According on the present invention, when the seamless charging tube is damaged, only the seamless charging tube may be changed with a new one. Thus the shaft and the conductive elastic cylinder can be reused.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
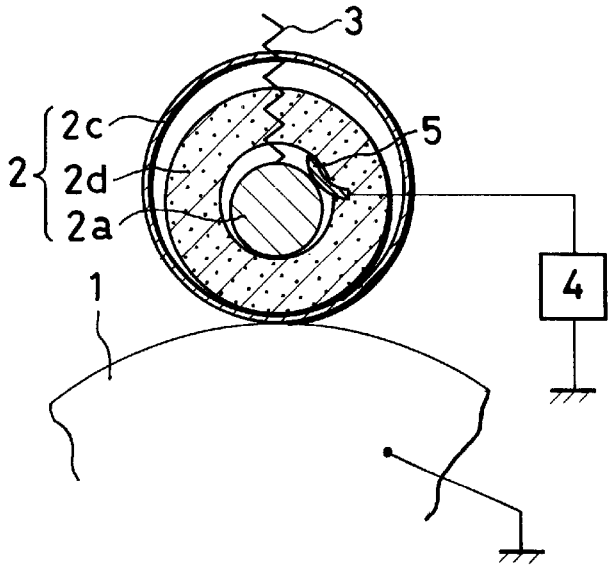
FIG. 1 is an explanatory sectional view showing an embodiment of a charging unit according to the present invention.

In FIG. 1, a charging unit 2 is constituted of a conductive shaft 2*a*, a conductive elastic cylinder 2*d* loosely encasing the shaft 2*a*, and a charging tube 2*c* loosely encasing the elastic cylinder 2*d*. The conductive elastic cylinder 2*d* is formed in a cylindrical shape having a suitable thickness. Meanwhile, the charging tube 2*c* is formed in a seamless tube shape having a thin thickness.

The shaft 2*a* is made of a metal, for example, stainless steel, iron and so forth. As to a conventional charging roller of an integrated type, an outer diameter of a shaft is generally 6 mm in case of a printer, a copying machine or the like for A4 size paper. In case of a printer for A3-size paper, the diameter of 8 mm is general. As described later, in the present invention, it is sufficient to be about 3 mm to about 5 mm for a printer for A4 size, and to be about 4 mm to about 6 mm for a printer for A3 size. Of course, the present invention is applicable to the shaft having a larger outer diameter including the conventional outer diameter. However, the cost may be lowered owing to the thin shaft. When the shaft is thin, the load torque of the bearing member is reduced so that a driving force for the charging unit 2 may be reduced.

The seamless charging tube 2*c* maybe formed by an extrusion method or an inflation method in which one or more kinds of conductive minute particles are dispersed in an elastomer or a modified material of a resin of polyester, polyamide, polyurethane, polyolefin, silicone and so forth. As to the conductive minute particle (about 0.1 micron to about 20 microns in maximum diameter), although the carbon black is general, it is possible to use tin oxide, titanium oxide, zinc oxide, copper, silver and so forth. Specific volume resistance of the charging tube 2*c* is usually set within a range of about $5\times10^4$ to $1\times10^8$ Ωcm, by adjusting adding amount of the conductive minute particles.

An inner diameter of the charging tube 2*c* is enough to be larger than an outer diameter of the elastic cylinder 2*d*. In practice, however, when the elastic cylinder 2*d* is encased by the seamless charging tube 2*c* (or the elastic cylinder 2*d* is inserted into the charging tube 2*c*), there is a possibility that the elastic cylinder 2*d* is rubbed against the charging tube 2*c* and can not be smoothly inserted. In order to avoid this, it is desirable to set a difference between the inner diameter of the charging tube 2*c* and the outer diameter of the elastic cylinder 2*d* at 0.2 mm or more, and preferably at 0.4 mm or more. The practical outer diameter of the charging tube 2*c* is about 8 mm to 20 mm when the charging unit of the present invention is used in the form of roller shape as a whole, i.e., the section of the charging tube 2*c* is almost circle as shown in FIG. 1. The outside of this range is usable. However, in case of the smaller diameter rather than the above range, the outer diameter of the shaft must be also reduced to less than 3 mm. Meanwhile, the shaft has a length of about 25 cm when it is used in the printer for A4-size paper. In view of this, the shaft is likely to be bent. On the other hand, in case of the larger diameter rather than the above range, a space for setting the charging unit 2 in a charging device becomes greater so that a request for a compact size is refused. Regarding the printer for A3 or larger size or a high speed printer, for example, 40 prints of A4 size per minute or more, the diameter of the charging tube 2*c* larger than the above range can be used.

The shape of the seamless charging tube 2*c* for the high speed printer can be belt-like rather than roller-like. In this case the seamless charging tube 2*c* is suspended on one or more guide rollers placed between the conductive elastic cylinder 2*d* and the seamless charging tube 2*c*. In other words the seamless charging tube 2*c* encases the conductive elastic cylinder 2*d* and the guide roller.

It is suitable that the charging tube 2*c* has a certain thickness so as to keep a circular or nearly circular sectional shape by itself. For this purpose the thickness of the charging tube 2*c* is desirable to be about 50 μm or more, and particularly 100 μm or more, although it depends on the stiffness of the material utilized. The upper limit is desirable to be about 300 μm. Charging tube 2*c* thicker than about 300 μm can be used in sacrifice of material consumption. The charging tube 2*c* may have two layer structure. The inner layer of such a charging tube has a specific volume resistance same order with that of the conductive elastic cylinder 2*d*. The outer layer of such a charging tube usually has the specific volume resistance set within a range of about $5\times10^4$ to $1\times10^8$ Ωcm.

With regard to the elastic cylinder 2*d*, synthetic rubber or natural rubber is used. For example, as the synthetic rubber, are used elastomer and a modified material of a resin of polyester, polyamide, polyurethane, polyolefin and so forth. At least one kind of the conductive minute particles, a foaming agent and a foaming assistant if desired are suitably compounded in the elastomer or the modified material to make a raw material. This raw material is supplied to an extruding machine to form a cylinder. The elastic cylinder 2*d* does not need to be the foamed material, but may be a solid phase material. The foamed material is preferable rather than the solid phase material, since the elastic cylinder having less hardness may be easily obtained. The specific volume resistance of the elastic cylinder 2*d* is desirable to be set within a range of about $10^2$ to $10^5$ Ωcm, by adjusting the amount of the conductive minute particles to be added.

The length of the elastic cylinder 2*d* in the axial direction is about 21 cm or 31 cm in case of the printer for A4-size paper, and may be shorter than that of the charging tube 2*a* by about 1 to 10 mm. Both ends of the elastic cylinder 2*d* are disposed so as to be positioned at the inside of both ends of the charging tube 2*c*. The reason forth this is as follows. If the elastic cylinder 2*d* is longer than the charging tube 2*c*, the end of the elastic cylinder 2*d* having smaller electric resistance directly contacts with a surface of a photosensitive drum so that an electric current concentrates at that portion. Hence, a pinhole is likely to be formed in a peripheral surface of the photosensitive drum. Another reason is as follows. In case the pinhole has already existed in the peripheral surface of the photosensitive drum, the electric current concentrates at that portion and unevenness of charging is caused.

The inner diameter of the elastic cylinder 2*d* is enough to be larger than the outer diameter of the shaft 2*a*. In practice, however, in order to easily insert the shaft 2*a* into the hollow of the elastic cylinder 2*d*, a difference between the inner diameter of the elastic cylinder 2*d* and the outer diameter of the shaft 2*a* is desirable to be 0.2 mm or more, and preferably to be 0.4 mm or more. In case the inner diameter of the elastic cylinder 2*d* is uniform, the difference may be smaller than 0.2 mm.

Figure 2:
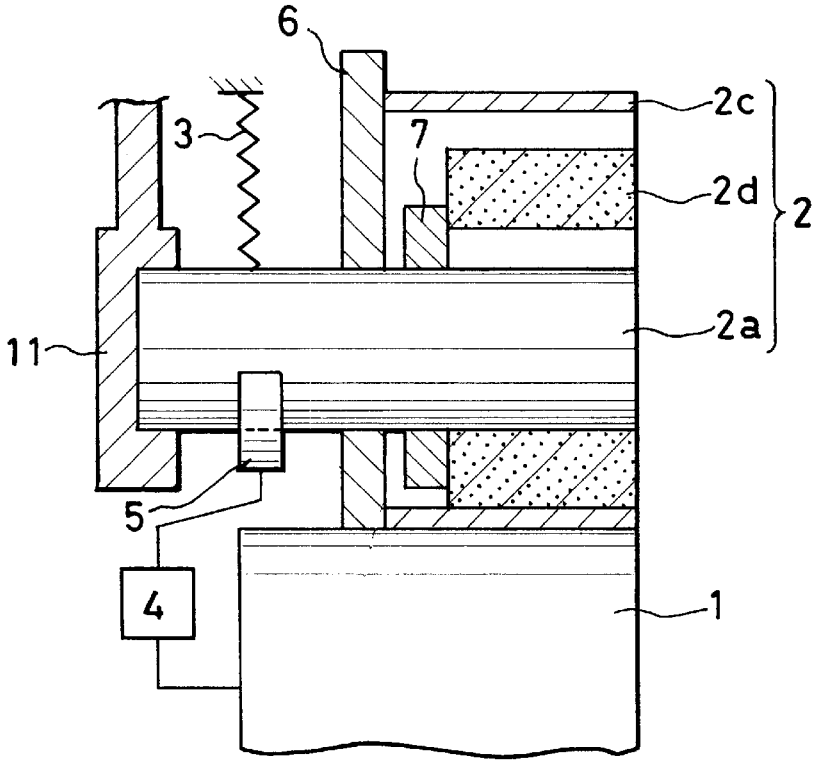
FIG. 2 is an explanatory section view partially showing a charging device using the charging unit shown in FIG. 1.

Referring to FIG. 2, is described an embodiment of a charging device using the charging unit according to the present invention. As to the charging unit 2, both ends of the shaft 2*a* are held by bearing members 11. A power supply 4 applies a voltage to the shaft 2*a* and the photosensitive drum 1 via a slide electrode 5. This voltage may be a DC voltage, otherwise may be a superposed voltage of a DC voltage and an alternating voltage.

The both ends of the shaft 2*a* are pressed toward the photosensitive drum 1 by means of a spring 3 to closely contact with the outer surface of the photosensitive drum 1. The total pressing force of the spring 3 is 1 Kg in the case of FIG. 9, and is as large as 1.4 Kg in the case of FIG. 10. These values are great. In the present invention, however, it is sufficient to be 500 g to 700 g which are substantially half of the above value. As a result, the outer diameter of the shaft 2*a* is enough to be 4 mm to 6 mm for a printer for A3-size paper. As for a pressure nip portion between the charging unit 2 and the photosensitive drum 1, is kept a state in that the shaft 2*a*, the elastic cylinder 2*d* and the charging tube 2*c* are closely contacted with each other.

In association with the rotation of the photosensitive drum 1, the charging tube 2*c* is forced to rotate by friction. In association with the rotation of the charging tube 2*c*, the elastic cylinder 2*c* is forced to rotate by friction. In association with the rotation of the elastic cylinder, the shaft 2*a* is forced to rotate by friction. The feature of the present invention is that the shaft 2*a*, the elastic cylinder 2*d* and the charging tube 2*c* are individually provided. In the prior art shown in FIG. 9, the shaft 2*a* and the foam layer 2*b* are integrated. In the prior art shown in FIG. 10, the elastic cylinder 2*d* and the charging tube 2*c* are integrated.

Figure 9:
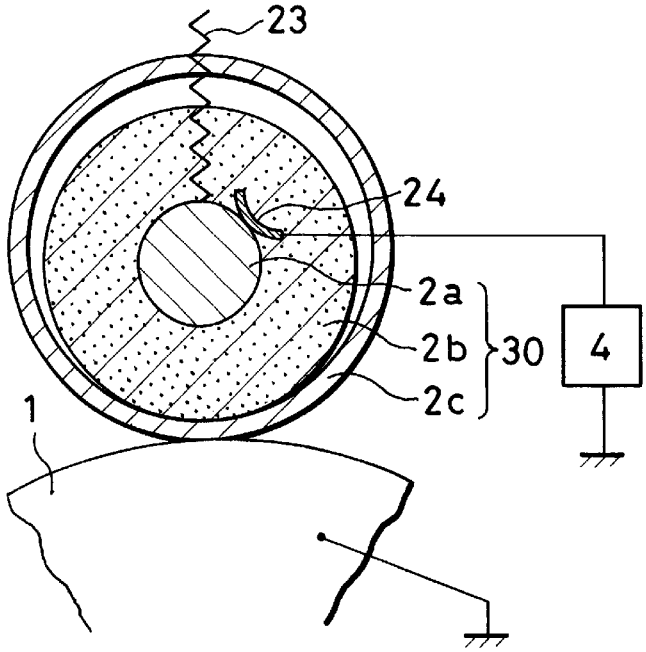
FIG. 9 (PRIOR ART)
FIG. 9 is an explanatory section view showing a conventional charging roller.

In FIG. 9, even if the outer diameters and the inner diameters of the shaft 2*a*, the foam layer 2*b* and the charging tube 2*c* are accurately manufactured so as to have predetermined dimensions, when the springs have the different pressing force, the outer diameters of the foam layer 2*b* at the both ends of the shaft 2*a* are different relative to the pressure portion between the charging roller 30 and the photosensitive drum. As a result, when the charging tube 2*c*, the foam layer 2*b* and the shaft 2*a* are driven to rotate in association with the rotation of the photosensitive drum, the charging tube 2*c* is moved in the axial direction of the shaft 2*a* (thrust movement). As the number of times of printing increases and hence the number of times of rotation of the charging roller 30 increases, one end of the charging tube 2*c* approaches the bearing member. Upon further rotation, the end of the charging tube 2*c* comes into contact with the bearing member. Upon furthermore rotation, the end of the charging tube 2*c* is strongly pressed against the bearing member so that the end of the charging tube 2*c* is sometimes turned up and deformed to be damaged. Moreover, the end of the foam layer is sometimes bared at the opposite end of the charging roller 30. Under such a condition, as stated above, a pinhole is likely to be generated in the surface of the photosensitive drum, and unevenness of charging is caused. In case the frictional force between the charging tube 2*c* and the foam layer 2*b* is small, such phenomenon hardly occurs. However, when pressed by the pressing force of 1 Kg such as the prior art shown in FIG. 9, the frictional force becomes considerably larger.

The foregoing description relates to an aspect in which the springs for pressing the both ends of the shaft 2*a* have the different pressing force. In practice, however, there is a limit in manufacturing accuracy of the respective members. It has been confirmed that charging tube 2*c* moves little by little in the axial direction of the shaft.

By contrast, in the charging unit 2 of the present invention shown in FIGS. 1 and 2, the shaft 2*a* and the elastic cylinder 2*d* are individually provided so that slipping may occur not only between the shaft 2*a* and the elastic cylinder 2*d* but also between the elastic cylinder 2*d* and the charging tube 2*c*. Owing to this, when a stopper 6 does not exist, the force of the charging tube 2*c* for directly pressing the bearing member is considerably reduced in comparison with the force of the charging tube for pressing the bearing member in FIG. 9. Slipping occurs in FIG. 9 only between the foam layer 2*b* and the charging tube 2*c*.

Figure 10:
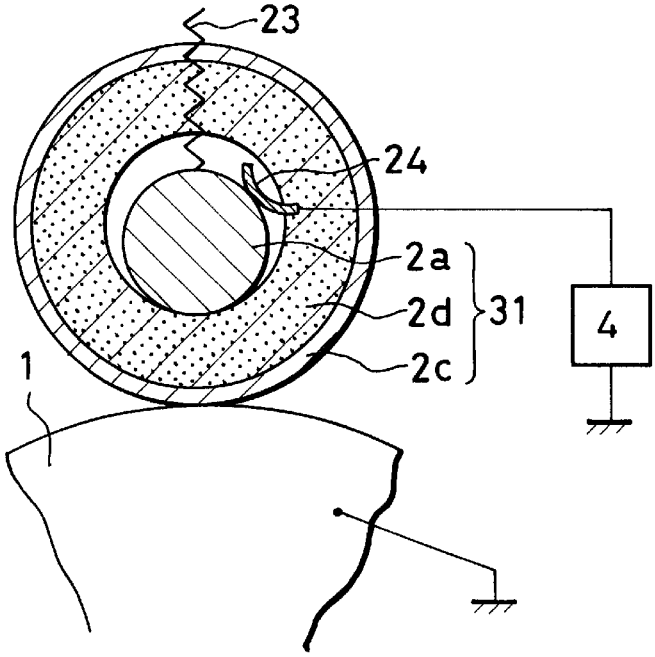
FIG. 10 (PRIOR ART)
FIG. 10 is an explanatory section view showing another conventional charging roller.

In the prior art shown in FIG. 10, the elastic cylinder 2*d* and the charging tube 2*c* are integrated so that the elastic cylinder 2*d* is pressed against the bearing member in accordance with the increase of the number of times of rotation, such as described above. Hence, creases are likely to be generated on the surface of the charging tube 2*c*. Thus, unevenness of charging is caused. In the present invention, slipping may occur between the elastic cylinder 2*d* and the charging tube 2*c* as well so that the creases are hardly generated. Accordingly, unevenness of charging is hardly caused. As mentioned above, the charging unit 2 according to the present invention has effects which are not expected from the combination of the known charging rollers shown in FIGS. 9 and 10.

The forgoing disadvantages of the known charging roller are solved by the present invention. The charging device or the charging unit 2 of the present invention shown in FIG. 1 has great effects, one of which is that the elastic cylinder 2*d* merely extruded by extruding machine can be used without grinding the surface thereof. With respect to the elastic cylinder 2*d* merely extruded, its outer diameters are usually different in accordance with positions in a longitudinal direction. For example, when the elastic cylinder 2*d* has the inner diameter of 5 mm and the outer diameter of 11 mm, the outer diameter may have a scatter of 0.5–1 mm within a range of the length of 20 cm. When the charging tube 2*c* is integrally formed on the surface of such a elastic cylinder 2*d*, the scatter of the outer diameter is transmitted to the outer diameter of the charging roller 31 as it is. In case charging is performed by using such a charging roller 31, a nip width between the charging roller 31 and the photosensitive drum changes in relation to the outer diameter of the charging roller 31. Thus, a charging amount changes in accordance with the nip width. Hence, unevenness of charging is caused.

By contrast, in the charging unit 2 of the present invention shown in FIG. 1, the elastic cylinder 2*d* and the charging tube 2*c* are independent with each other. Owing to this, the contact width between the charging tube 2*c* and the photosensitive drum 1, or the nip width is constant, although the contact widths between the elastic cylinder 2*d* and the charging tube 2*c* vary due to the scatter of the outer diameter of the elastic cylinder 2*d*. The reason for this is as follows. When the elastic cylinder 2*d* has a larger-diameter portion and a smaller-diameter portion which are alternately positioned in a longitudinal direction, consider the smaller-diameter portion between the adjacent two larger-diameter portions. A film itself for forming the charging tube 2*c* is a material having small rigidity and being easily deformed by a small force. However, when formed in the tube shape, large rigidity is obtained in the longitudinal direction. Thus, when the nip portion is formed by the adjacent two larger-diameter portions, the portion between them becomes the nip portion having the similar shape. A further lucid explanation is as follows. A PPC copy paper is rolled to form a paper cylinder, and hands are inserted into openings of both ends thereof. Then, the paper cylinder is pressed so as to have an ellipsoid. Upon this, a central portion of the paper cylinder is adapted to also have an ellipsoid similar to the both ends thereof. This assists in understanding the foregoing. In virtue of such properties, the charging unit 2 shown in FIG. 1 can perform uniform charging despite the usage of the elastic cylinder 2*d* which is merely formed by the extruding machine without grinding the surface thereof. The above-mentioned phenomenon is utilized so that, in the present invention, it is not necessary to tightly press the charging unit 2 against the surface of the photosensitive drum 1 by the greater pressing force, differently from an embodiment described in Japanese Laid-Open Publication No. 5-273844. As a result, the life of the photosensitive drum 1 is considerably extended.

The present invention comprises the shaft, the seamless charging tube and the conductive elastic cylinder which are independent with each other. In order to solve the trouble of the end portion, and in order to solve the problems regarding the material of the respective members, the shape thereof, the limit of the manufacturing accuracy of the foam layer and so forth, the charging tube and the elastic cylinder are constituted so as to compensate these problems with each other. Owing to this, the foregoing effects are achieved. In contrast, the structures shown in FIGS. 9 and 10 do not disclose any part of the effects according to the present invention. Thus, it is difficult to easily expect the effects of the present invention by combining the both structures.

The charging unit 2 shown in FIG. 2 is provided with a stopper 6 and a regulating member 7. One end of the charging tube 2*c* is adapted to abut on the stopper 6 before abutting on the bearing member 11. In virtue of this, it is possible to prevent the opposite end of the elastic cylinder 2*d* from being bared. Meanwhile, the regulating member 7 is for preventing the end face of the elastic cylinder 2*d* from protruding out of the end of the charging tube 2*c*. In case a part of the elastic cylinder 2*d* comes into contact with the surface of the photosensitive drum 1, unevenness of charging is caused. This is prevented by the regulating member 7.

Figure 3A:
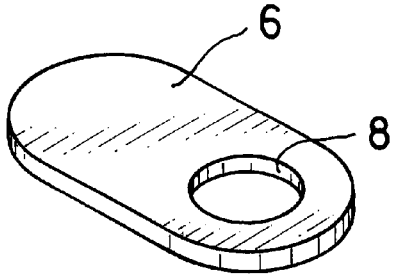
FIGS. 3A to 3C are perspective views showing an example of a stopper and a regulating member.
Figure 3B:
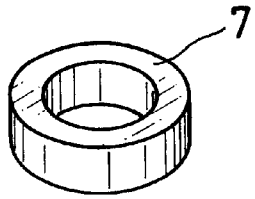

FIGS. 3A and 3B show perspective view of the stopper 6 and the regulating member 7 respectively. The stopper 6 is, for example, formed in a rectangular shape or in a shape in which corners of the rectangle are removed so as to be curved. Otherwise, the stopper 6 is formed from an elliptic flat plate. A diameter of a hole 8 formed in the stopper 6 is adapted to be larger than the outer diameter of the shaft 2*a* so as to be freely rotatable around the shaft 2*a*. The hole 8 is not formed at a central portion of the stopper 6, but is formed at a biased position. The regulating member 7 may be integrally fixed to the shaft 2*a*. Otherwise, the regulating member 7 may be rotatable around the shaft 2*a*. Further, the regulating member 7 may be fixed to the end face of the elastic cylinder 2*d* by means of adhesion or the like.

Figure 3C:
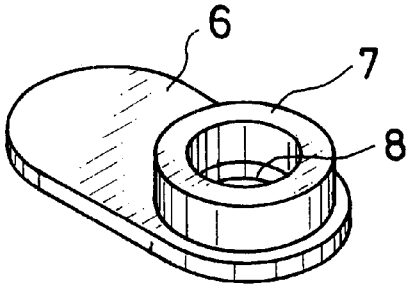

In FIGS. 3A and 3B, the stopper 6 and the regulating member 7 are individually formed. Such as shown in FIG. 3C, however, they may be integrated. In case of integration, the regulating member 7 must be also rotatable around the shaft 2*a*. When the photosensitive drum 1 is rotated, the stopper 6 tries to rotate in association therewith. However, the hole 8 of the stopper 6 is formed at the biased position so that a far-off portion from the hole 8 abuts on the surface of the photosensitive drum 1 to prevent the rotation. Hence, the stopper 6 is adapted to slip on the surface of the photosensitive drum. Since the stopper 6 directly contacts with the surface of the photosensitive drum, it is desirable to make it from an electrically insulating resin having a small coefficient of friction. Thickness of the regulating member 7 is preferable to be about 0.2–2 mm. A length from the hole 8 of the stopper 6 to the far-off portion (roughly a distance from the center of the hole 8 to the top of the far-off portion) is desirable to be shorter within a range that the end of the charging tube 2*c* is allowed to abut on the far-off portion. For example, it is enough to be larger than the maximum radius of the charging tube 2*c* by an extent of 1–2 mm. Thickness of the stopper 6 is desirable to be 0.1–1 mm. In case the thickness of the stopper 6 is thinner than the above range, a mechanical strength is small so that it is likely to be deformed. In case the thickness of the stopper 6 is thicker than the above range, the material is wastefully used.

Figure 4A:
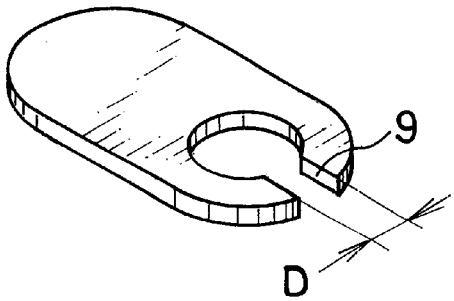
FIGS. 4A and 4B are perspective views showing another example of the stopper and the regulating member.
Figure 4B:
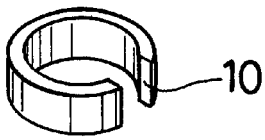

FIGS. 4A and 4B show perspective view of another regulating member 7. An end portion of the stopper 6 near to the hole 8 is provided with a cut-out portion 9. The width D of the cut-out portion 9 is set so as to be smaller than the outer diameter of the shaft 2*a* by about 0.2–1 mm. When the stopper 6 is attached to the shaft 2*a*, instead of inserting the end of the shaft 2*a* into the hole 8, the cut-out portion 9 of the stopper 6 is pressed against the side of the shaft 2*a*. Upon strongly pushing the stopper 6, a skirt of the cut-out portion 9 is elastically deformed to broaden the width of the cut-out portion 9 so that the shaft 2*a* is put into the hole 8. Once the shaft 2*a* is inserted into the hole 8, the width of the cut-out portion 9 is returned to the previous size. Thus, it becomes difficult to easily release their engagement. The regulating member 7 is also provided with a cut-out portion 10. The width of the cut-out portion 10 is also set so as to be smaller than the outer diameter of the shaft 2*a* by about 0.2–1 mm. The cut-out portion 10 of the regulating member 7 is pressed against a predetermined position of the shaft 2*a* and is strongly pushed. Upon this, the regulating member 7 is attached to the shaft 2*a* similarly to the stopper 6. A diameter of the hole of the regulating member 7 is adapted to be smaller than the outer diameter of the shaft 2*a* by about 0.1–0.5 mm. Owing to this, the regulating member 7 strongly holds the shaft 2*a* so that the shaft 2*a* may be securely fixed.

Figure 5:
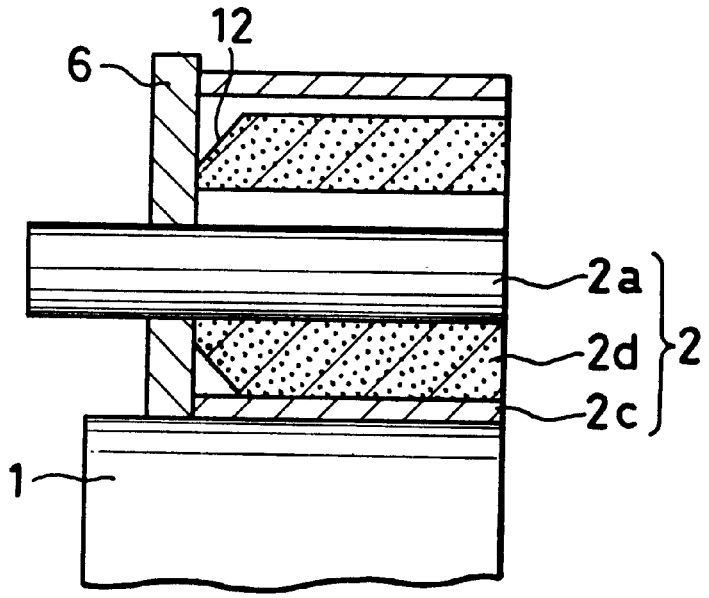
FIG. 5 is a section view showing a shape of an end portion of a conductive elastic cylinder.

FIG. 5 shows sectional view of an edge shape of the elastic cylinder 2*d*. The edge of the elastic cylinder 2*d* lacks its peripheral portion. Reference numeral 12 denotes a lack portion. When the edge of the elastic cylinder 2*d* has such a shape, the edge portion of the elastic cylinder 2*d* does not come into contact with the surface of the photosensitive drum 1, even though the stopper 6 contacts with the edges of the charging tube 2*c* and the elastic cylinder 2*d*. Accordingly, the regulating member, which regulates the edge of the elastic cylinder 2*d* so as not to protrude out of the edge of the charging tube 2*c*, becomes unnecessary. In other words, the stopper is also used as the regulating member. In order to form the lack portion 12 at the edge of the elastic cylinder 2*d*, a cutting blade is slantingly pressed, rotating the elastic cylinder 2*d* around its central axis, for example. In stead of rotating the elastic cylinder 2*d*, the cutting blade may be rotated. Otherwise, the peripheral portion of the elastic cylinder 2*d* may be cut out by a punch having a cylindrical blade. In the present invention, it is not required that the lack portion 12 always has a smooth tapered shape. The lack portion may also be formed in a stepwise shape. It is sufficient to cut the edge portion of the elastic cylinder 2*d* such that this edge portion does not come into contact with the surface of the photosensitive drum without protruding from the edge of the charging tube 2*c*.

When the charging unit 2 is transported or is handled during assembly before attaching to a cartridge or an image forming apparatus, the charging tube 2*c* and the elastic cylinder 2*d* are likely to drop out from the shaft 2*a*. In order to prevent this, a drop preventing member may be provided between the stopper 6 and the setting position of the bearing member. For example, a regulating member shown in FIG. 4B may be integrally attached to the shaft 2*a*. Otherwise, an O-ring made of rubber may be fitted. An inner diameter of the O-ring is smaller than the outer diameter of the shaft 2*a*. Further, a concentric disk may be fitted through the edge of the shaft. An inner diameter of the concentric disk is slightly smaller than the outer diameter of the shaft 2*a*.

Figure 6:
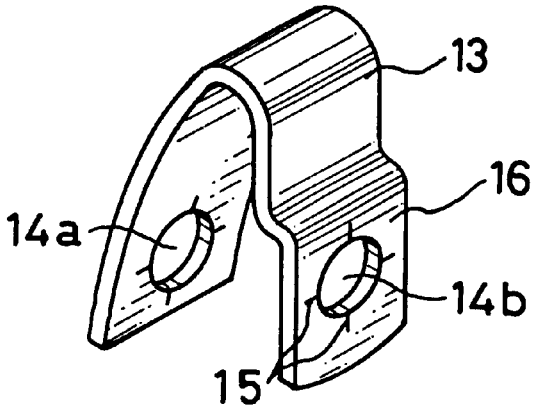
FIG. 6 is a perspective view showing an example of a drop preventing member having a stopper function and regulating member function.
Figure 7:
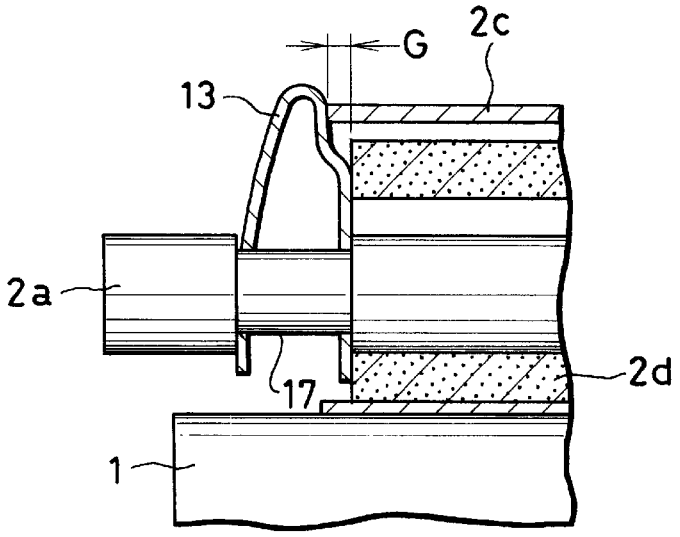
FIG. 7 is a section view of one side of the charging unit to which the drop preventing member shown in FIG. 6 is attached.

FIG. 6 shows perspective view of the drop preventing member 13 which is used both as the stopper and the regulating member. FIG. 7 shows one side of the charging unit using the member 13. This member 13 is a resin piece formed in an arch-like shape and is provided with holes 14*a* and 14*b* formed near its both ends. One side of the arch is bend from a halfway portion so as to form another arch 16. This second arch 16 is formed with the hole 14*b*. Around the hole, are provided notches 15 having a length of about 0.5–1 mm. The number of the notches is preferably 1 to 4. Diameters of both holes are smaller than the outer diameter of the shaft 2*a* by about 0.2–1 mm. Meanwhile, a groove 17 having a depth of about 0.1–0.5 mm is formed in a perpendicular direction to the axis within an area of about 5–10 mm from the end of the shaft 2*a*. The groove 17 has a width of about 5 mm and circles around the axis. Although the diameters of both holes are smaller than the outer diameter of the shaft 2*a*, both holes of the member 13 may be easily fitted to the shaft 2*a* in virtue of the notch 15. When both holes of the member 13 are fitted to the groove 17 of the shaft 2*a* such as shown in FIG. 7, it is difficult to take it off. If necessary, however,the member 13 may be taken off by a strong force without damaging it. The second arch 16 works as the regulating member of the conductive elastic cylinder 2*d*. The first arch works as the stopper of the seamless charging tube 2*c*. The member 13 works as the drop preventing member in the aggregate. A step between the first arch and the second arch 16 (a portion shown by a letter D in FIG. 7) is desirable to be about 0.2–2 mm.

The integrated stopper 6 shown in FIG. 3*c* can be fitted to the groove 17. In this case the diameter of the hole 8 is set to be smaller than the outer diameter of the shaft 2*a* and larger than the outer diameter of the groove 17, and the diameter of the hole of the regulating member 7 larger than the outer diameter of the shaft 2*a*. Preferably, 1 to 4 notches are formed around the hole 8 to easily slide the integrated stopper 6 along the shaft 2*a* and fit the groove 17.

In FIG. 7, the two holes 14*a* and 14*b* have the same diameter. However, the diameter of the hole 14*a* may be large than the outer diameter of the shaft 2*a* by about 0.1–0.5 mm, and the width of the groove 17 of the shaft 2*a* may be larger than the thickness of the member 13 by about 0.1–0.5 mm. In this case, only the hole 14*b* is fitted to the groove 17, and the hole 14*a* is fitted to a portion of the shaft 2*a* where the groove does not exist. Since the width of the groove 17 is satisfied to be small, machine processing of the groove becomes easy.

The stopper 6, the regulating member 7 and the member 13 are made by injection molding of a resin, for example, polyester, polycarbonate, ABS, polypropylene and polyamide. Otherwise, they are made by cutting a flat plate and bending the cut flat palate.

The bearing member is not exclusive to the one merely having the bearing function. The bearing member may be formed with a member working as the stopper and/or the regulating member (for example, a flat-plate member such as shown in FIG. 3A) in order to be also used as the stopper and/or the regulating member. Upon this, it becomes unnecessary to provide the stopper and/or the regulating member in particular.

Figure 8:
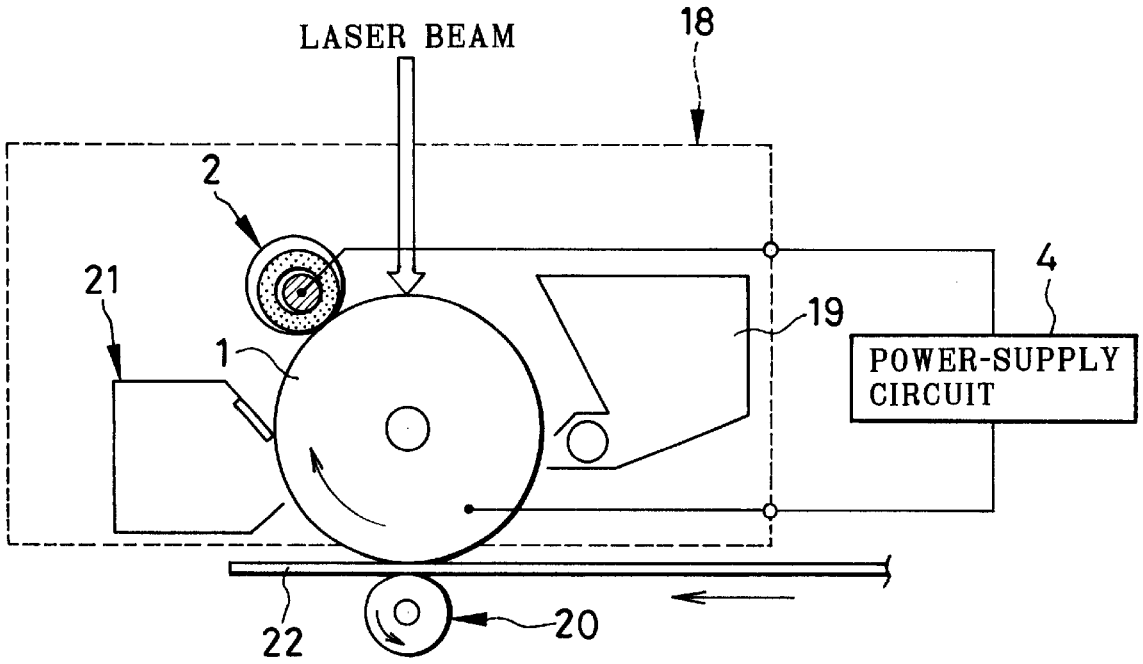
FIG. 8 is an explanatory illustration of a process cartridge using the charging unit according to the present invention.

Instead of attaching the stopper and/or the regulating member to the shaft 2*a*, it is possible, as shown in FIG. 8, to provide them in a cartridge to which the charging unit is attached, otherwise in a non-cartridge type image forming apparatus including a development section, a transfer section and a cleaner section.

Figure 11:
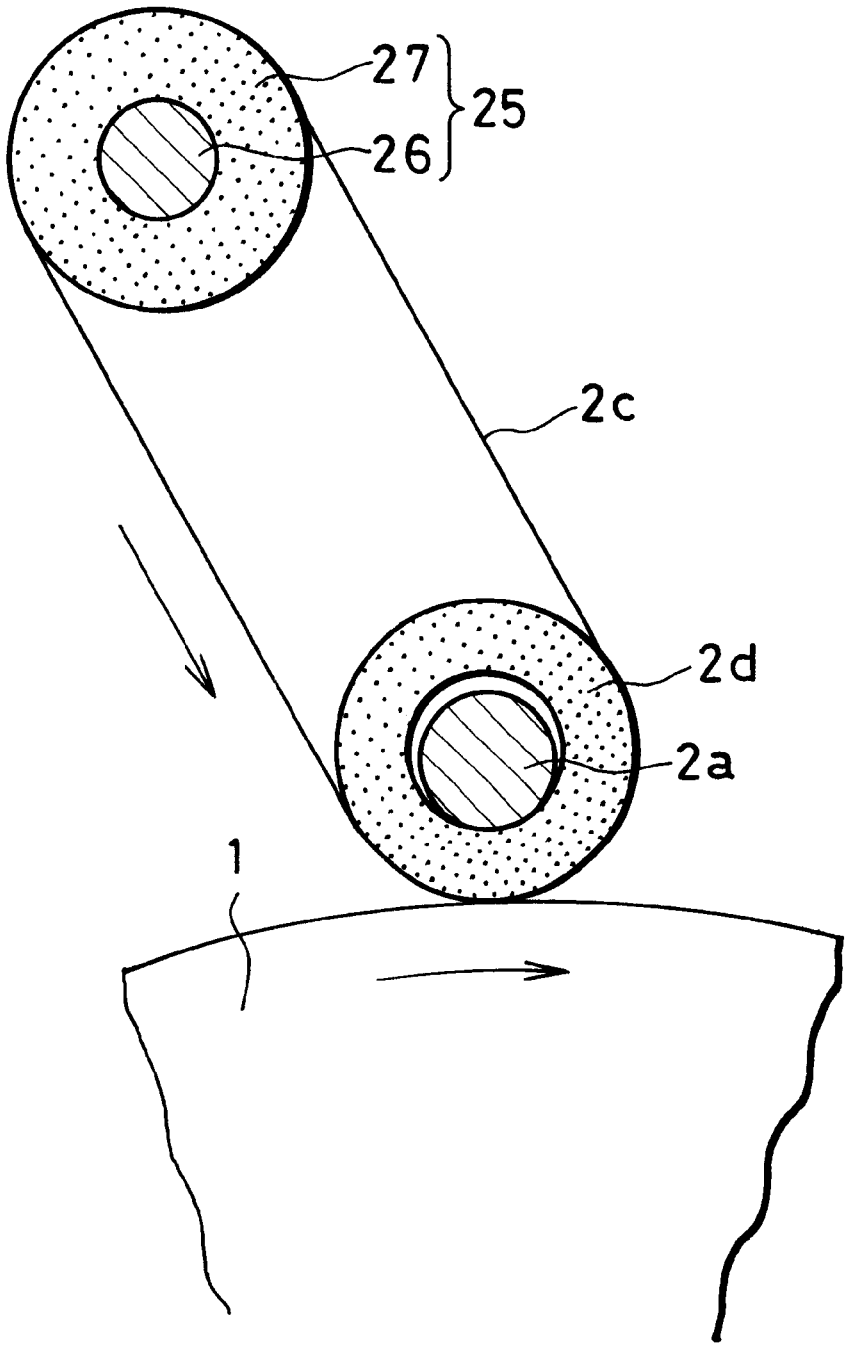
FIG. 11 is an explanatory sectional view showing another embodiment of a charging unit according to the present invention.

In FIG. 11, a charging unit modified from the one shown in FIG. 1 is shown. The seamless charging tube 2*c* is belt-like rather than roller-like. One side thereof is suspended on the conductive elastic cylinder 2*d* which loosely encases shaft 2*a*. The other side thereof is suspended on a guide roller 25 consisting of, for example, shaft 26 and elastic cylinder 27. In association with the rotation of the photosensitive drum 1, the charging tube 2*c* is forced to rotate by friction. In association with the rotation of the charging tube 2*c*, both of the elastic cylinder 2*d* and the guide roller 25 are forced to rotate by friction. This embodiment of the charging unit is particularly suitable for the high speed printer, since the life of the charging tube 2*c* is more extended than that shown in FIG. 1 as described below. The circumference of the charging tube 2*c* in FIG. 11 is set 5 to 10 times that shown in FIG. 1, and hence the charging tube 2*c* contacts with the photosensitive drum 1 less number of times (⅕ to ⅒) than that shown in FIG. 1, realizing 5 to 10 times longer life. Besides the guide roller 25, one or more guide rollers can be placed between the seamless charging tube 2*c* and the conductive elastic cylinder 2*d*.

In the above embodiment, is described the charging device using the charging unit according to the present invention. However, the charging unit of the present invention is applicable to a transfer device for transferring a toner image to a plain paper or the like. When the toner image formed on a charged surface is transferred, a receiving medium such as paper is inserted between the charged surface having the toner image and the charging unit, and the surface of the paper is charged to draw the toner image to the receiving medium by electrostatic force. Thus, a principle which is substantially identical with charging is used.

Conventionally, a shaft around which a conductive foam layer is integrally formed is used as a transfer roller. However, the transfer roller comes into contact with paper being as a receiving material so that paper powder is likely to stick to the surface of the transfer roller. It is known that conductivity of the surf ace of the transfer roller is changed as the sticking paper powder increases. Hence, transfer performance is deteriorated. Thus, it is necessary to exchange the transfer roller in that case. Conventionally, the whole of the transfer roller has been exchanged. This is not preferable relative to the environment.

When the charging unit of the present invention is used for the transfer device, electric resistance of the charging tube 2*c* shown in FIG. 1 is desirable to be greater by one to three figures in comparison with a case of usage as the charging unit, in order to prevent the toner from splashing. Thus, the specific volume resistance of the charging tube 2*c* is desirable to be set within a range of about $10^6$ to $10^8$ Ωcm. When the charging unit of the present invention is used as the transfer unit, only the charging tube 2*c* may be exchanged if its surface is deteriorated by the paper powder and so forth. Accordingly, there are advantages relative to the cost of maintenance and the environment.

Next, an Example is described below.

EXAMPLE 1

A semi-conductive polymer, in which conductive carbon was mixed into polyamide elastomer, was formed in a tube-like shape by extruding machine. This formed one was cut to obtain a seamless charging tube 2*c* having a length of 225 mm. Specific volume resistance of the seamless charging tube 2*c* was about $1.5\times10^6$ Ωcm. The thickness of the charging tube 2*c* was 150 μm and the outer diameter thereof was 12 mm. Meanwhile, foaming agents were properly added in Ethylene-Propylene-Diene Methylene linkage (EPDM) rubber in which the conductive carbon was mixed so as to adjust its specific volume resistance to $10^4$ Ωcm. This mixture was contained in the extruding machine and was formed in a pipe shape. This formed one was cut in a perpendicular direction to its length direction to obtain a conductive elastic cylinder 2*d* having a length of 217 mm. An inner diameter was 5 mm and an outer diameter was 11 mm. The elastic cylinder 2*d* was used without being ground.

The shaft 2*a* made of stainless steel was prepared. The shaft 2*a* had an outer diameter of 4 mm and a length of 250 mm. Next, two concentric disks made of polypropylene were prepared as the regulating member 7 shown in FIG. 3B. The disk had a thickness of 0.5 mm, an inner diameter of 4.5 mm and an outer diameter of 7.5 mm. Two flat plates made of polyester and having a shape shown in FIG. 3A were prepared as the stopper 6. A length was 18 mm, a width was 10 mm, a diameter of the hole was 4.5 mm, and a thickness was 0.25 mm. Further, two concentric disks made of polyester were prepared as the drop preventing member of the stopper. This concentric disk had a thickness of 0.25 mm, an inner diameter of 3.95 mm, and an outer diameter of 8 mm. The shape of the drop preventing member was similar to the regulating member 7 shown in FIG. 3B.

The charging unit was assembled such as set forth below. One of the drop preventing members was pressed from one end (end A) of the shaft 2*a* to a position separating from the end by 5 mm. Successively, one of the stoppers 6 and one of the regulating members 7 were fitted in order from an opposite end (end B). Further, the elastic cylinder 2*d* was fitted. The charging tube 2*c* was placed through the end B so as to encase the elastic cylinder 2*d*. The regulating member 7 and the stopper 6 were fitted in order. Finally, the drop preventing member was pressed to a position separating from the end B by 5 mm.

The charging unit 2 obtained in this way was used in a cartridge (process cartridge) 18 for an electrophotographic printer shown in FIG. 8. The cartridge 18 was provided with the photosensitive drum 1, the charging unit 2, a developing unit 19 and a cleaner 21 which were removably attached. In FIG. 8, reference numeral 22 denotes a recording paper as a receiving material, and reference numeral 20 denotes a transfer roller. A DC voltage of −700 V and an alternating voltage of 2 kV were superposed and were applied to the charging unit 2 from the power supply 4. Incidentally, a frequency of the alternating voltage was 600 Hz. Under a normal environment (23° C., 55% RH), thirty thousand prints were made. Meanwhile, ten thousand prints were made under a high-temperature high-humidity environment (32° C., 80% RH), and other ten thousand prints were made under a low-temperature low-humidity environment (15° C., 10% RH). Fifty thousand prints were made in total and durability of the charging unit was estimated. As a result, under all the environments, a change in image quality was hardly recognized relative to beginning and end of duration test.

After the above-described evaluation test, the charging unit was taken out from the cartridge and inspected. It was observed that layers of toner particles were formed on the seamless charging tube. The charging tube thus inspected was discarded and a new charging tube having the same configuration was installed into the cartridge. The same procedure as described above was performed and almost the same results as above were obtained.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A charging unit comprising:

a shaft;

a conductive elastic cylinder loosely encasing said shaft; and a seamless charging tube loosely encasing said conductive elastic cylinder.

2. A charging unit according to claim 1, further comprising:

a stopper for preventing said seamless charging tube from continuing to move in an axial direction of said shaft, said stopper being rotatably attached to said shaft and between an edge of said seamless charging tube and an end of said shaft at both sides of said shaft.

3. A charging unit according to claim 2, further comprising:

a member for preventing an edge of said conductive elastic cylinder from protruding out of both ends of said seamless charging tube.

4. A charging unit according to claim 2, further comprising:

a member for preventing said stopper from moving toward the end of said shaft, said member being disposed between said stopper and the end of said shaft to prevent said stopper from dropping out of said shaft.

5. A charging unit according to claim 2, wherein said conductive elastic cylinder lacks a peripheral portion of the end thereof.

6. A charging unit according to claim 2, wherein said seamless charging tube is a semi-conductive polymer in which conductive carbon is dispersed in polyamide elastomer.

7. A charging unit according to claim 6, wherein said seamless charging tube has a thickness of 50–300 $\mu$m.

8. A charging unit according to claim 6, wherein specific volume resistance of said seamless charging tube is within a range of $5\times10^4$ to $1\times10^8$ Ωcm.

9. A charging unit according to claim 2, wherein said elastic layer is Ethylene-Propylene-Diene Methylene rubber in which conductive carbon and foaming agents are added.

10. A charging unit according to claim 9, wherein specific volume resistance of said conductive elastic cylinder is within a range of $10^2$ to $10^5$ Ωcm.

11. A charging unit according to claim 1, wherein said shaft and/or said conductive elastic cylinder is a reused one.

12. A charging unit according to claim 1, wherein said seamless charging tube is suspended on at least one guide roller placed between said seamless charging tube and said conductive elastic cylinder.

13. A process cartridge integrally comprising:

a charging unit as described in claim 1;

at least one of a photosensitive drum, a developing means and a cleaning means;

said process cartridge being able to be mounted on or dismounted from an electrophotographic image forming apparatus.

14. A device for charging a material by applying a charging voltage between the material and the surface of a charging unit comprising;

said charging unit comprising a shaft, a conductive elastic cylinder loosely encasing said shaft and a seamless charging tube loosely encasing said conductive elastic cylinder;

a bearing member for holding both ends of said shaft; and a pressure means for closely contacting said seamless charging tube with said material to be charged by pressing said shaft toward the material to be charged.

15. A charging device according to claim 14, further comprising:

a stopper for preventing said seamless charging tube from continuing to move in an axial direction of said shaft, said stopper being rotatably attached to said shaft and between an edge of said seamless charging tube and an end of said shaft at both sides of said shaft.

16. A charging device according to claim 14, further comprising:

a member for preventing an edge of said conductive elastic cylinder from protruding out of both ends of said seamless charging tube.

17. A charging device according to claim 14, further comprising:

a member for preventing said stopper from moving toward the end of said shaft, said member being disposed between said stopper and the end of said shaft to prevent said stopper from dropping out of said shaft.

18. A charging device according to claim 14, wherein said conductive elastic cylinder lacks a peripheral portion of the end thereof.

19. A charging device according to claim 14, wherein said bearing member has a structure preventing said seamless tube from continuing to move in an axial direction of said shaft.

20. A device for transferring a toner image formed on a material to a recording medium by applying a toner-transfer voltage between the material and a surface of a charging unit with the recording medium disposed therebetween comprising;

said charging unit comprising a shaft, a conductive elastic cylinder loosely encasing said shaft and a seamless charging tube loosely encasing said conductive elastic cylinder;

a bearing member for holding both ends of said shaft; and a pressure means for closely contacting said seamless charging tube with said material to be charged by pressing said shaft toward the material having thereon a toner image.

21. A toner transfer device according to claim 20, wherein specific volume resistance of said seamless charging tube is within a range of $10^6$ to $10^8$ Ωcm.

* * * * *